US007952277B2

(12) United States Patent
Shinohe et al.

(10) Patent No.: US 7,952,277 B2
(45) Date of Patent: May 31, 2011

(54) PLASMA DISPLAY PANEL

(75) Inventors: Koji Shinohe, Kawasaki (JP); Toshiyuki Akiyama, Yamanashi (JP); Takashi Yamada, Yamanashi (JP); Yasuyuki Noguchi, Hyogo (JP)

(73) Assignees: Advanced PDP Development Center Corporation, Tokyo (JP); Hitachi, Ltd., Tokyo (JP); Panasonic Corporation, Osaka (JP)

( * ) Notice: Subject to any disclaimer, the term of this patent is extended or adjusted under 35 U.S.C. 154(b) by 887 days.

(21) Appl. No.: 11/826,797

(22) Filed: Jul. 18, 2007

(65) Prior Publication Data

US 2008/0018563 A1 Jan. 24, 2008

(30) Foreign Application Priority Data

Jul. 18, 2006 (JP) ..... 2006-195566

(51) Int. Cl.
*H01J 17/49* (2006.01)

(52) U.S. Cl. ..... 313/582

(58) Field of Classification Search ..... 313/582–587, 313/490–494

See application file for complete search history.

(56) References Cited

U.S. PATENT DOCUMENTS

| | | | |
|---|---|---|---|
| 6,788,004 | B1 | 9/2004 | Aoki et al. |
| 7,215,303 | B2 | 5/2007 | Ando et al. |

FOREIGN PATENT DOCUMENTS

| | | |
|---|---|---|
| CN | 1434975 A | 8/2003 |
| JP | 4-36924 | 2/1992 |
| JP | 08-022772 | 1/1996 |
| JP | 2001-216904 | 8/2001 |
| JP | 2003-331740 | 11/2003 |
| JP | 2004-272199 | 9/2004 |
| JP | 2006-120583 | 5/2006 |
| KR | 10-2001-0048515 | 6/2001 |
| KR | 10-2001-0093283 | 10/2001 |
| KR | 2001-0093283 | 10/2001 |

OTHER PUBLICATIONS

English Translation of KR 10-2001-10048515 A.*

Korean Office Action mailed on Jan. 19, 2010 in corresponding Koren Patent Application 10-2009-0037596.

Korean Patent Office Action, mailed May 28, 2008 and issued in a corresponding Korean Patent Application.

* cited by examiner

*Primary Examiner* — Toan Ton
*Assistant Examiner* — Hana S Featherly
(74) *Attorney, Agent, or Firm* — Staas & Halsey LLP

(57) ABSTRACT

A PDP is proposed which has high emission efficiency and which can decrease address discharge voltage. In a column direction of at least one of transparent electrodes, which perform sustain discharge via respective discharge gaps of a pair of row electrodes and constituting a row electrode pair, is set to 150 μm or less, and partial pressure of xenon in discharge gas sealed in a discharge space is set to 6.67 kPa or more. A width of a scan electrode, which is one row electrode of each of the row electrode pair facing the column electrode and to which scan pulse is applied, is wider than a width of the other row electrode of the pair to which discharge sustain voltage is applied.

9 Claims, 11 Drawing Sheets

PLASMA DISPLAY PANEL

CROSS-REFERENCE TO RELATED APPLICATIONS

This application is based upon and claims the benefit of priority from the prior Japanese Patent Application No. 2006-195566, filed on Jul. 18, 2006, the entire contents of which are incorporated herein by reference.

BACKGROUND OF THE INVENTION

1. Field of the Invention

The present invention relates to a configuration of a plasma display panel, and more particularly to a configuration of a plasma display panel which can decrease the address discharge voltage and can prevent the dispersion of voltage.

2. Description of the Related Art

A surface discharge type AC plasma display (hereafter PDP) normally forms a discharge space by sealing discharge gas between two glass substrates facing each other. One glass substrate side (hereafter front substrate) of the two glass substrates, and a plurality of row electrode pairs which extend in the row direction, are formed in parallel in the column direction, and the plurality of row electrode pairs are covered by a dielectric layer.

On the other glass substrate side (hereafter rear substrate) of the two glass substrates, a plurality of column electrodes, which extend in the column direction, are formed in parallel in the row direction. And in an area facing the portions of the discharge space where the row electrode pairs and the column electrodes are crossed, discharge cells having red, green and blue fluorescent layers are formed, and these discharge cells are arrayed in a matrix on the panel face.

For the discharge gas sealed between the two glass substrates, discharge gas containing xenon of which volume ratio 1 to 10%, for example, is used.

In a PDP having this structure, an address discharge is selectively generated between one row electrode, out of the pair of row electrodes forming the row electrode pair, and a column electrode and an emission cell (discharge cell where a wall electric charge is formed in a dielectric layer of the counter portion) or a non-emission cell (discharge cells where a wall electric charge is erased in the dielectric layer of the counter portion) is selected. By this, the emission cells and non-emission cells are distributed on the panel face corresponding to the image data of the video signal.

When a sustain pulse is alternately applied to the row electrodes forming a pair of each row electrode pair, a sustain discharge is generated in an emission cell, and by this sustain discharge, a vacuum ultraviolet ray is generated from the xenon in the discharge gas in the discharge space. By the generated vacuum ultraviolet ray, red, green and blue fluorescent layers in each emission cell are excited and visible lights are generated, and as a result, an image corresponding to the image data based on the matrix display is formed on the panel face.

In a PDP having the above configuration, conventionally the dimensions of the row electrode have been set as follows.

FIG. 1 shows a plane configuration of a portion having one discharge cell C, out of a row electrode pair of a conventional PDP, and in FIG. 1, the row electrodes X and Y, which constitute a row electrode pair (X, Y), comprise strip type transparent electrodes Xa and Ya which extend in the row direction in parallel with each other, and face each other via a discharge gap g in a column direction, and strip type bus electrodes Xb and Yb, which are electrically connected to the transparent electrodes Xa and Ya and extend in a row direction respectively.

In FIG. 1, D is a column electrode.

The width W of each row electrode X and Y of this conventional PDP is generally set to a value of 400 to 1000 μm (e.g. see Japanese Patent Application Laid-Open No. H8-22772).

And in this conventional PDP, the width of the row electrode in the column direction is set as above for the following reason.

In other words, in PDP, the fluorescent layer is excited by a resonance line, which is a main component of the vacuum ultraviolet ray generated from xenon in the discharge gas by a sustain discharge and has a wavelength of 147 nm, and visible light is generated, and in the process of propagating through the discharge gas toward the fluorescent layer, the resonance line collides with xenon atoms in the discharge gas, and attenuates due to absorption and radiation which repeats with xenon atoms.

Therefore in the case of PDP in which discharge gas, of which partial pressure of xenon is low, such as a volume ratio of xenon containing 1 to 10%, is sealed in, the quantity of the resonance line which reaches the fluorescent layer during sustain discharge decreases, and the required brightness may not be acquired.

Therefore in a conventional PDP, the width w of each row electrode X and Y in the column direction is set wide, as shown in FIG. 1, so that a sustain discharge is generated in a wide area in the discharge cell C, and the quantity of vacuum ultraviolet rays (that is the quantity of the resonance line) generated by the sustain discharge is increased so that the quantity of the resonance line which reaches the fluorescent layer becomes more than a predetermined value, and brightness more than a predetermined value is secured.

However in the configuration of the conventional PDP, the high emission efficiency required for creating a high brightness screen cannot be implemented.

To solve this problem, the present inventors discovered a preferable mode after considering various ideas and experiments, and proposed this in the previous application (Japanese Patent Application No. 2005-241274).

A characteristic of the mode disclosed in this previous application (hereafter simply called "previous application") is that the respective width in the column direction of a pair of row electrodes, constituting the row electrode pair, at a portion related to the discharge which is performed via the respective discharge gap, is set to 150 μm or less, and discharge gas of which partial pressure of xenon is set to 6.67 kPa or more is sealed in the discharge space between the front glass substrate and the rear glass substrate.

However further examination by the present inventors showed that this characteristic structure of the previous application secures brightness more than a predetermined value, but the address discharge voltage is increased, and the address discharge voltage disperses due to an accuracy error in the panel structure.

SUMMARY OF THE INVENTION

With the foregoing in view, it is an object of the present invention to provide a plasma display panel which can solve the increase of the address discharge voltage and the dispersion of the address discharge voltage due to an error in the panel structure when the characteristic structure disclosed in the previous application is used.

A first aspect of the plasma display panel according to the present invention for achieving the above object is a plasma display panel having: a pair of substrates facing each other with a discharge space therebetween; a plurality of row electrode pairs which extend in a row direction and are formed in parallel in a column direction on one substrate side out of the pair of substrates, each pair being formed by row electrodes facing each other via a discharge gap respectively; a dielectric layer formed on the one substrate side and covering the row electrode pairs; and a plurality of column electrodes which extend in a column direction and are formed in parallel in a row direction on the other substrate side of the pair of substrates, a unit emission area being formed with a discharge space at each portion where the column electrode and row electrode pair cross, and discharge gas containing xenon being sealed in the discharge space, wherein a width in a column direction of at least one electrode of a pair of row electrodes constituting the row electrode pair is set to 150 μm or less, a partial pressure of xenon in the discharge gas is set to 6.67 kPa or more, and a width of one row electrode of each of the plurality of row electrode pairs, which faces the column electrode and to which scan pulse is applied, is wider than a width of the other row electrode of the pair.

In the first aspect, it can be constructed that each row electrode constituting the row electrode pair has a transparent electrode which has a predetermined width in the column direction, and faces the other row electrode pair via a discharge gap, and a metal bus electrode which has a width smaller than the transparent electrode in the column direction, extends in a strip in the row direction and is electrically connected with the transparent electrode.

In the first aspect, it can be constructed that barriers are formed substantially in a lattice shape between the pair of substrates by a plurality of first wall sections which extend in parallel in the row direction and a plurality of second wall sections which extend in parallel with the column direction, and a discharge space is divided into individual unit emission areas by the barriers, and the row electrode is disposed at a position facing the unit emission area obtained by division by the barriers respectively.

A second aspect of the plasma display panel according to the present invention for achieving the above object is a plasma display panel having: a pair of substrates facing each other with a discharge space therebetween; a plurality of row electrode pairs which extend in a row direction and are formed in parallel in a column direction on one substrate side out of the pair of substrates, each pair being formed by row electrodes facing each other via a discharge gap respectively; a dielectric layer formed on one substrate side and covering the row electrode pairs; and a plurality of column electrodes which extend in a column direction and are formed in parallel in a row direction on the other substrate side, a unit emission area being formed in a discharge space at each portion where the column and row electrode pair cross, and discharge gas containing xenon being sealed in the discharge space, wherein the dielectric layer has a thin film portion and a thick film portion of which thickness is thicker than the thin film portion, the thin film portion of the dielectric layer is a dielectric layer covering an area having a width of 150 μm or less in a column direction in the tip portion at the discharge gap side on at least one row electrode of the row electrode pair, and a thin film having a width in the column direction wider than the width in the column direction of the thin film which is set to 150 μm or less is formed on the other row electrode of the row electrode pair, and a partial pressure of xenon in the discharge gas is set to 6.67 kPa or more.

In the second aspect, it can be constructed that the thickness of the thick film portion of the dielectric layer is set to double the thickness of the thin film portion of the dielectric layer or more.

In the second aspect, it can be constructed that the thin film portion of the dielectric layer is formed in a strip shape extending in the row direction.

In the second aspect, it can be constructed that the thin film portion of the dielectric layer is formed in an island shape for each unit emission area, and the thick film portion is formed substantially in a lattice shape enclosing these thin film portions.

Also in the second aspect, it can be constructed that barriers are formed substantially in a lattice shape between the pair of substrates, by a plurality of first wall sections which extend in parallel in the row direction and a plurality of second wall sections which extend in parallel in the column direction, and a discharge space is divided into individual unit emission areas by the barriers, and the row electrode is disposed at a position facing the unit emission area obtained by division by the barriers respectively.

A third aspect of the plasma display panel according to the present invention for achieving the object is a plasma display panel having: a pair of substrates facing each other with a discharge space therebetween; a plurality of row electrode pairs which extend in a row direction and are formed in parallel in a column direction on one substrate side out of the pair of substrates, each pair being formed by row electrodes facing each other via a discharge gap respectively; a dielectric layer formed on one substrate side and covering the row electrode pairs; and a plurality of column electrodes which extend in a column direction and are formed in parallel in a row direction on the other substrate side, a unit emission area being formed in a discharge space at each portion where the column electrode and row electrode pair cross, and discharge gas containing xenon being sealed in the discharge space, wherein a secondary electron emission layer of which width in the column direction is 150 μm or less is formed with a high γ material on a tip portion at a discharge gap side on a dielectric layer covering at least one row electrode out of the row electric pair, and a secondary electron emission layer, of which width in the column direction is wider than the width in the column direction of the high γ material being set to 150 μm or less, is formed with a high γ material on a dielectric layer covering the other row electrode of the row electrode pair, and a partial pressure of xenon in the discharge gas is set to 6.67 kPa or more.

DESCRIPTION OF THE PREFERRED EMBODIMENTS

Embodiments of the present invention will now be described with reference to the drawings. The embodiments are provided to understand the present invention, and they do not limit the technical scope of the present invention.

A PDP according to the first embodiment of the present invention has a configuration that a width in the column direction of at least one electrode of the row electrode pair is set to 150 μm or less, and the width of the row electrode to which a scan pulse is applied is wider than the width of the other row electrode of the pair, and discharge gas of which partial pressure of xenon is set to 6.67 kPa or more is sealed in a discharge space between a front glass substrate and a rear glass substrate.

Figure 1:
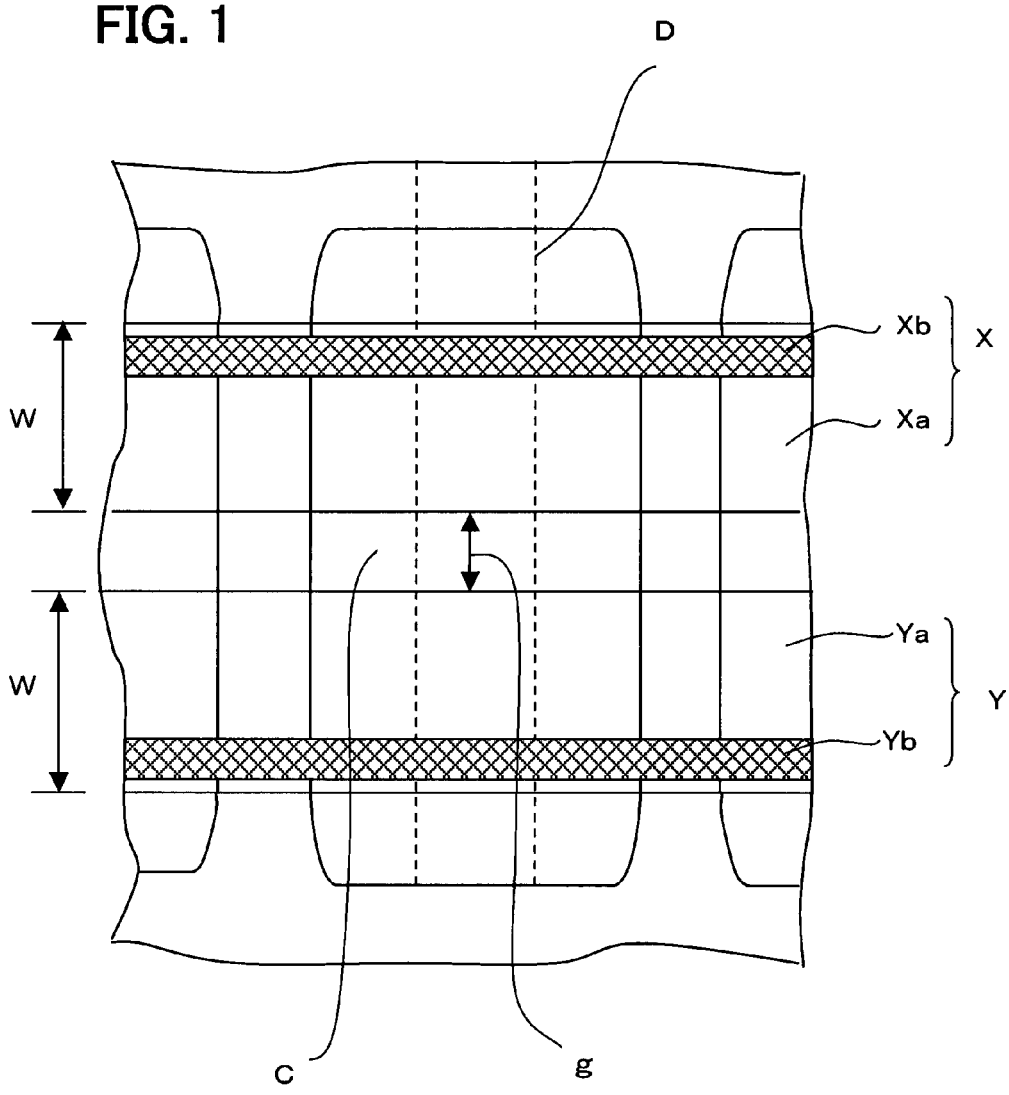
FIG. 1 is a front view depicting a configuration of a conventional PDP.

In the previous application, the widths in the column direction of a pair of row electrodes X and Y as shown in FIG. 1 are set to 150 μm or less respectively, and partial pressure of xenon in the discharge gas cell C is set to 6.67 kPa or more, and as a result, high emission efficiency is implemented.

However the present inventors experienced that the address discharge voltage becomes higher than prior art by the configuration such as proposed by the previous patent application and that the dispersion of the structure influences the dispersion of the voltage.

Figure 2:
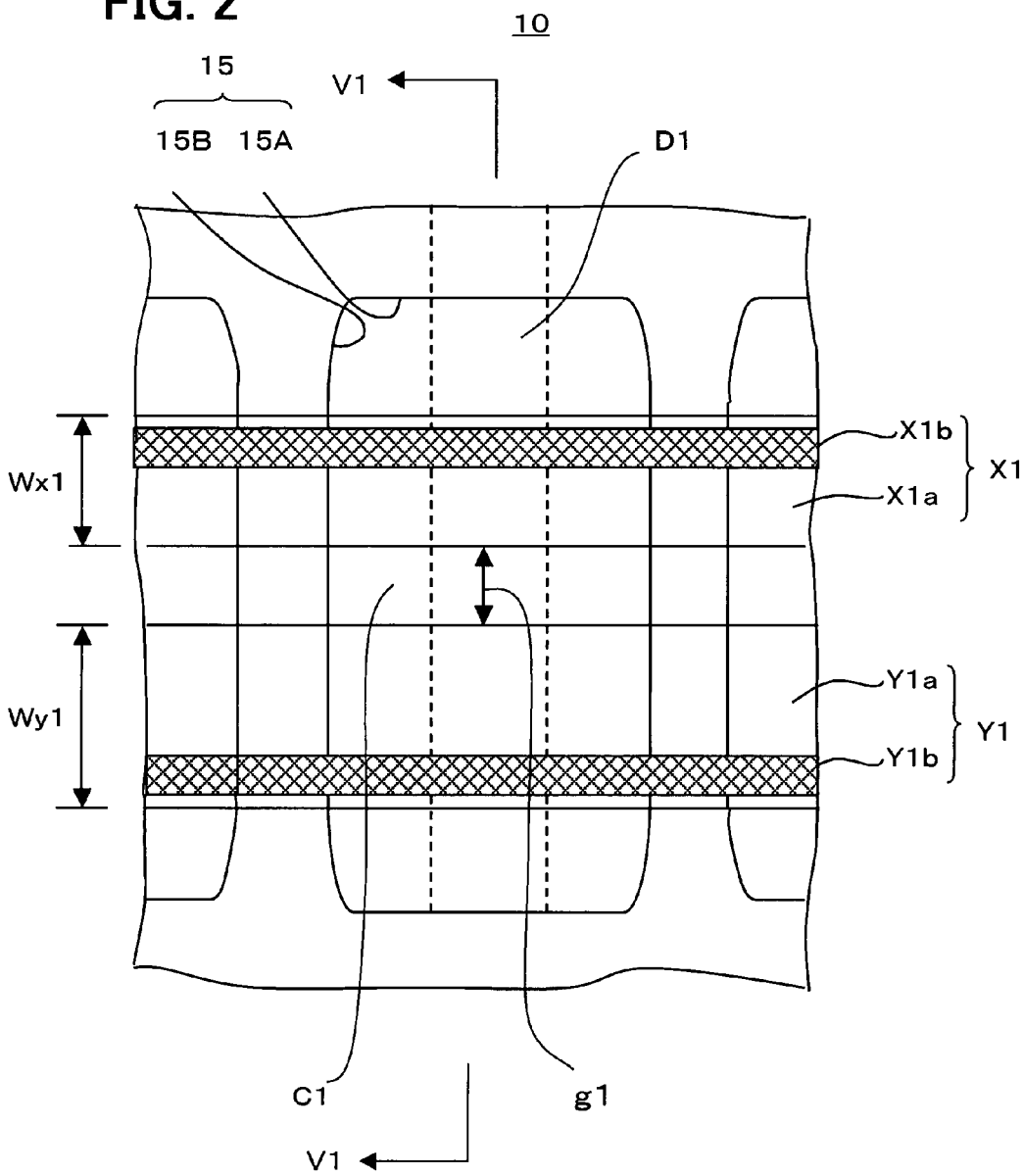
FIG. 2 is a front view depicting a first example of an embodiment of the present invention.

As a result of further examinations to solve these problems, the present inventors discovered that these problems can be solved by setting the electrode width of a row electrode, to which a scan pulse is applied as a scan electrode of at least one of the row electrodes X1 and Y1 (assumed to be Y1 in this case), to be wider than the electrode width of the other row electrode (X1), as shown in FIG. 2.

In the present invention, the width in the column direction of at least one electrode out of a pair of row electrodes is set to 150 μm or less. By this, the depth where a discharge is generated between the row electrodes in a unit emission area of the discharge space becomes narrower than a conventional PDP, and the growth area of this discharge is limited to a narrow area near the discharge gap, overlapping with an initial grow discharge generation area.

By this, vacuum ultraviolet rays are generated from xenon in the discharge gas at higher efficiency than a conventional PDP.

Since the partial pressure of xenon in the discharge gas is set to 6.67 kPa or more, the fluorescent layer is excited mainly by the molecular line of which wavelength is 172 nm, out of the vacuum ultraviolet rays generated from xenon in the discharge gas, and the molecular line is hardly attenuated in the process of propagating through the discharge gas, unlike the resonance line.

Because of this, the vacuum ultraviolet rays sufficiently reach the fluorescent layer even if the discharge generated between the row electrodes is localized in a range near the discharge gap, so the characteristics of generating vacuum ultraviolet rays at a higher efficiency than a conventional PDP are exhibited as is, and high emission efficiency can be implemented.

The characteristics of a discharge are determined by the width in the column direction of the narrower one of the row electrode pair, so this effect is acquired merely by setting the width in the column direction of at least one electrode of the row electrode pair (X1 in the case of FIG. 2) to 150 μm or less. The lower limit value of the row electrode width is preferably 30 μm or more in terms of manufacturing.

Figure 3:
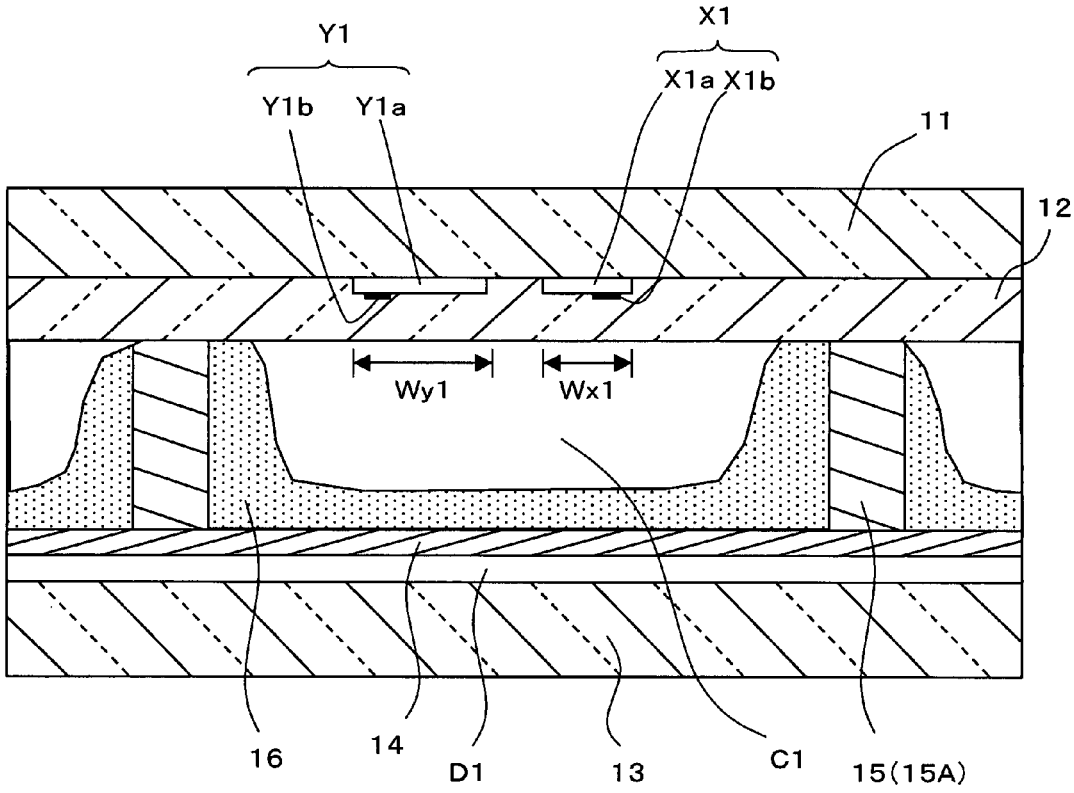
FIG. 3 is a cross-sectional view sectioned at the V1-V1 line in FIG. 2.

FIG. 2 and FIG. 3 show an embodiment of the PDP according to the present invention, where FIG. 2 is a front view depicting a part of the PDP of the present embodiment, and FIG. 3 is a cross-sectional view sectioned at the V1-V1 line in FIG. 2.

As shown in FIG. 2 and FIG. 3, in a PDP 10, a plurality of row electrode pairs (X1, Y1), which extend in the row direction (lateral direction in FIG. 2), are formed with a predetermined equal space in parallel in the column direction (longitudinal direction in FIG. 2) on the rear surface of the front glass substrate 11, which is a display surface.

One row electrode X1 of the row electrode pair (X1, Y1) is comprised of a transparent electrode X1*a*, which extends in the row direction formed in a strip shape with a transparent conductive film, such as ITO, on the rear surface of the front glass substrate 11, and a bus electrode X1*b*, which extends in the row direction formed in a strip shape with a metal film of which width in the column direction is narrower than the width in the column direction of the transparent electrode X1*a* on the rear surface of the transparent electrode X1*a*.

The other row electrode Y1 constituting the row electrode pair (X1, Y1) is also formed in the row direction in a strip shape with a transparent conductive film, such as ITO, on the rear surface of the front glass substrate 11, just like the row electrode X1, and is comprised of a transparent electrode Y1*a* extending in parallel with the transparent electrode X1*a* of the row electrode X1 with a predetermined space g1, and a bus electrode Y1*b* extending in the row direction formed in a strip shape with a metal film of which width in the column direction is narrower than the width in the column direction of the transparent electrode Y1*a* on the rear surface of the transparent electrode Y1*a*.

The characteristics of the present invention are that the width Wy1 in the column direction of one electrode Y1 of the row electrode pair (X1, Y1) is set to be wider than the width Wx1 in the column direction of the other electrode X1. Wx1, however, is 150 μm or less, as described above.

The row electrodes X1 and Y1 are alternately arrayed along the column direction on the front glass substrate 11. In the row electrode pair (X1, Y1), the predetermined width of a space between the transparent electrodes X1*a* and Y1*a*, which face each other, of the row electrodes X1 and Y1 which form a pair constitutes the discharge gap g1 respectively.

A dielectric layer 12 is also formed on the rear surface of the front glass substrate 11, and the row electrode pair (X1, Y1) is covered with the dielectric layer 12.

Also a secondary electron emission layer, which is not illustrated, made from high γ material, such as magnesium oxide (MgO), is formed so as to cover the entire dielectric layer 12.

A rear glass substrate 13 faces this front glass substrate 11 in parallel via a discharge space.

A plurality of column electrodes D1, which extend in a strip shape in the column direction, are formed on a surface of the rear glass substrate 13 facing the front glass substrate 11, with an equal predetermined space in the row direction.

A column electrode protective layer (dielectric layer) 14 is also formed on the surface of the rear glass substrate 13, and the column electrodes D1 are covered with the column electrode protective layer 14.

Barriers 15, having the following shape, are formed on the column electrode protective layer 14.

In other words, the barriers 15 are formed substantially in a lattice shape by a plurality of first wall sections 15A, which extend in the row direction respectively at a position facing a center position between the row electrode pairs (X1, Y1) adjacent to each other in the column direction, and by a plurality of second wall sections 15B, which extend in the column direction and are formed in parallel in the row direction with a predetermined equal space.

A plurality of discharge cells C1 arrayed in a matrix on the panel face are formed by dividing the discharge space between the front glass substrate 11 and the rear glass substrate 13 substantially into square shapes by the barriers 15.

The row electrode pair (X1, Y1) face each other respectively at the center portion of each discharge cell C1.

In each discharge cell C1, a fluorescent layer 16 is formed so as to cover five surfaces, that is the four side surfaces of the first wall sections 15A and second wall sections 15B of the barrier 15 facing the discharge space in the discharge cell C1 and the surface of the column electrode protective layer 14, and the colors of the fluorescent layer 16 are arrayed so that three primary colors, red, green and blue, sequentially line up in the row direction for each discharge cell C1.

In the discharge space, a discharge gas containing xenon is sealed. In other words, just like the previous application, a partial pressure of xenon in the discharge gas, sealed in the discharge space, is set to 6.67 kPa (50 Torr) or more.

In this PDP 10, a scan pulse is sequentially applied to the row electrode Y1 of each row electrode pair (X1, Y1), and at the same time, a data pulse is selectively applied to the column electrode D1. At this time, in a discharge cell C1, formed at an area where a row electrode Y1, to which the scan pulse is applied, and a column electrode D1, to which the data pulse is applied, cross, an address discharge is generated between the row electrode Y1 and the column electrode D1.

An emission cell formed by the address discharge (discharge cell C1 where wall charges are formed in the dielectric layer 12 in a facing portion) and a non-emission cell (discharge cell C1 where wall charges in the dielectric layer 12 in a facing portion are erased) are distributed on the panel face corresponding to the image data of the video signal.

Then a sustain pulse is applied to the row electrode X1 and Y1, which form a pair of each row electrode pair (X1, Y1) alternately, and a sustain discharge is generated between the transparent electrodes X1*a* and Y1*a* via the discharge gap g1 in the emission cell.

And in the emission cell, vacuum ultraviolet rays are generated from xenon in the discharge gas sealed in the discharge space by the sustain discharge, and a fluorescent layer 16 with red, green and blue in the emission cell, is excited by the vacuum ultraviolet rays, and a visible light is generated, and as a result, an image based on a matrix display is generated on the panel face.

Figure 4A:
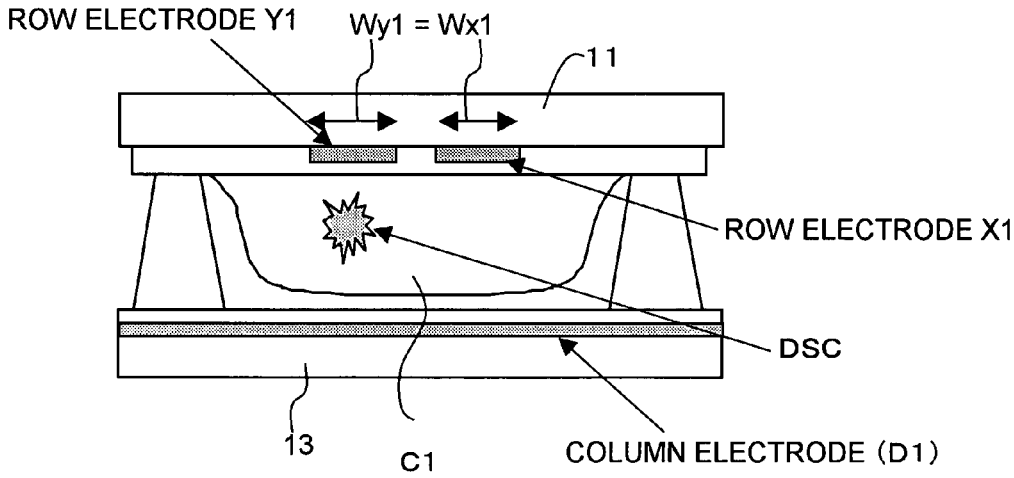
FIG. 4A is a diagram depicting a comparison with the invention of a previous application, where the depths (electrode widths) of the row electrode X1 and Y1 are the same.
Figure 4B:
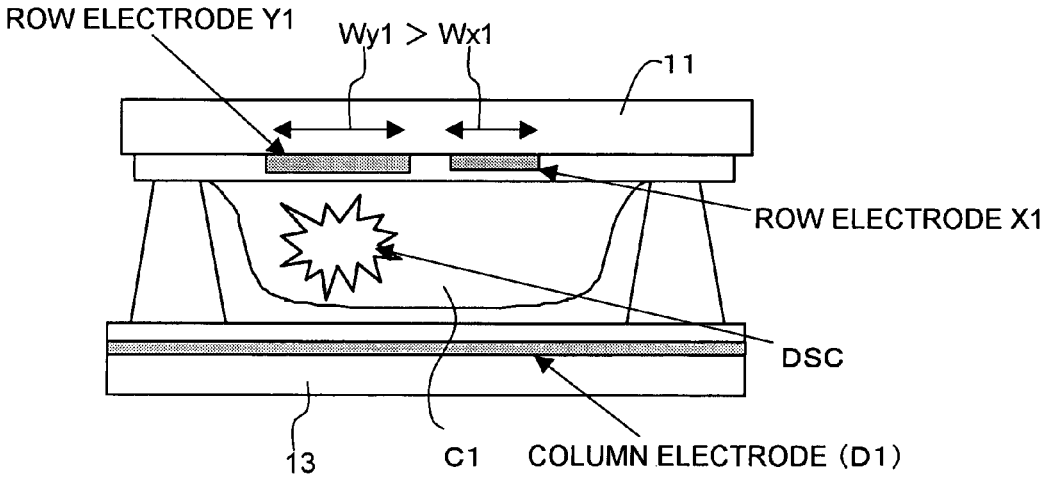
FIG. 4B is a diagram depicting that the address discharge voltage can be decreased by the present invention.

FIG. 4A and FIG. 4B are cross-sectional views depicting the previous application and the present invention. FIG. 4A is a diagram depicting the case when the electrode widths Wx1 and Wy1 of the row electrodes X1 and Y1 are the same. Since the electrode width of the row electrode has been decreased to improve the above mentioned emission brightness, the address discharge voltage, to start discharge by the voltage applied to the intersection of the address electrode D1 and the scan electrode Y1, is increased.

Whereas in the present invention, shown in FIG. 4B, the electrode width Wy1 of the row electrode Y1, where the scan pulse is applied to an area with the column electrode D1, is increased more than the electrode width Wx1 of the other row electrode X1. By this, the address discharge voltage can be decreased. Also the influence of dispersion in the structure can be decreased. At the same time, the characteristics of discharge are maintained, and discharge with high emission efficiency can be performed.

Figure 5:
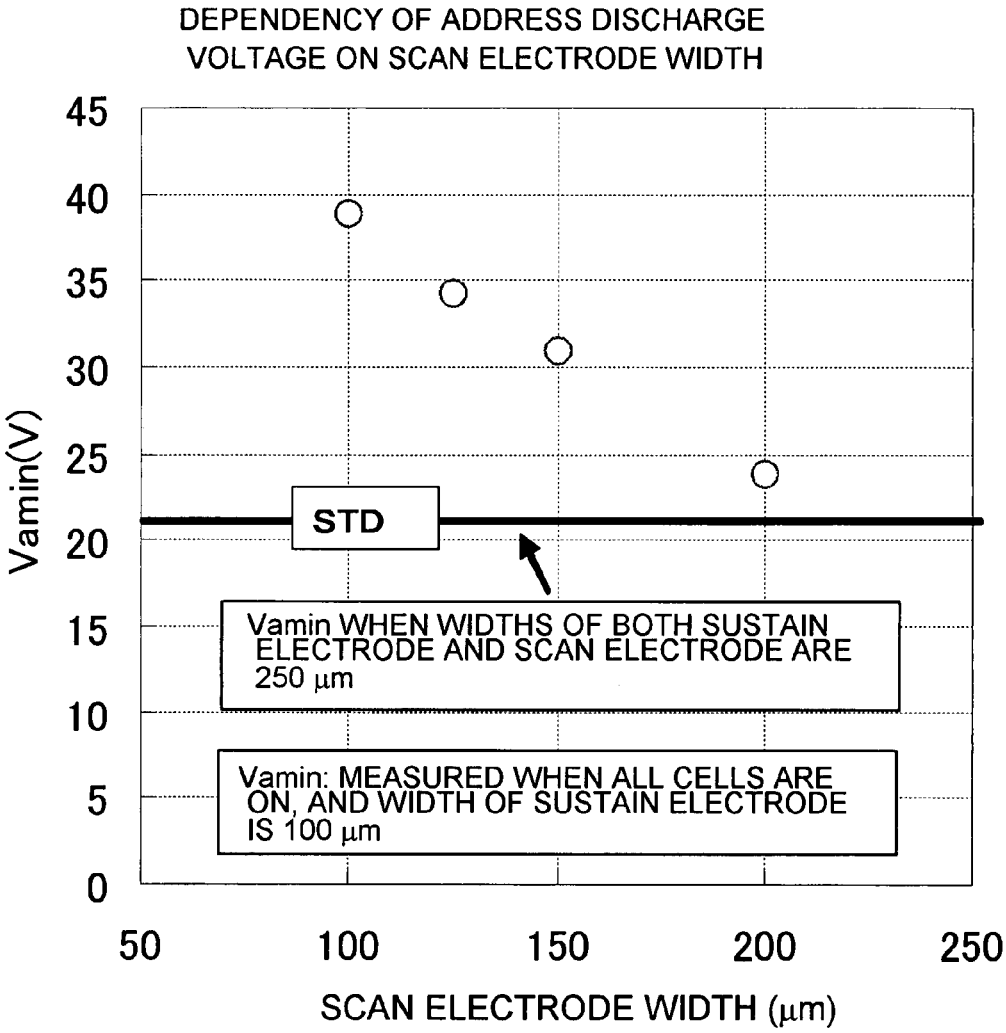
FIG. 5 is a graph when the dependence of the address voltage on the scan electrode width was measured.

FIG. 5 is a graph when the dependency of the address discharge voltage on the electrode width of the row electrode Y1, to which the scan pulse is applied, was measured. The cell size of the panel used for measurement is 700 μm×310 μm and the aperture size is 640 μm×250 μm. Measurement was performed using 20 vertical cells×192 horizontal cells, a total of 3840 cells of this panel.

Here it is assumed that Vamin is the address discharge voltage when all cells are turned ON ($3840^{th}$ cell turns ON) while the address discharge voltage was gradually increased. And assuming that the electrode width of the row electrode X1 is 100 (<150) μm, Vamin was determined, while the electrode width of the row electrode Y1 was increased.

As a result, it was confirmed that the value of Vamin decreases as the electrode width of the row electrode X1 increases, exceeding the electrode width of the row electrode Y1.

In FIG. 5, STD is Vamin when both the electrode width of the row electrode X1 and the electrode width of the row electrode Y1 are 250 μm, and is approximately 20V. In the PDP used for measurement in FIG. 5, xenon pressure is 13.34 kPa, and neon pressure is 53.36 kPa.

When both the electrode width of the row electrode X1 and the electrode width of the row electrode Y1 are 250 μm, Vamin is approximately 20V. Therefore by increasing the electrode width of the row electrode Y1 with respect to the electrode width of the row electrode X1, Vamin becomes closer to this, and as described above, the problem of an increase in the address discharge voltage, which occurs when the widths of a pair of the row electrodes are set to 150 μm or less, can be solved.

In the previous application, a discharge with high emission efficiency is sustained by setting the widths of a pair of row electrodes to 150 μm or less respectively, but in the present invention, it was discovered that a discharge with high emission efficiency can be sustained if the width in the column direction of at least one electrode of a pair of row electrodes is 150 μm or less.

In FIG. 4A, the width Wx1 in the column direction of each row electrode X1 and the width Wy1 in the column direction of the transparent electrode Y1 are 150 μm or less respectively, and a partial pressure of xenon in the discharge gas in the discharge space is set to 6.67 kPa (50 Torr) or more, so high emission efficiency can be implemented.

Figure 6:
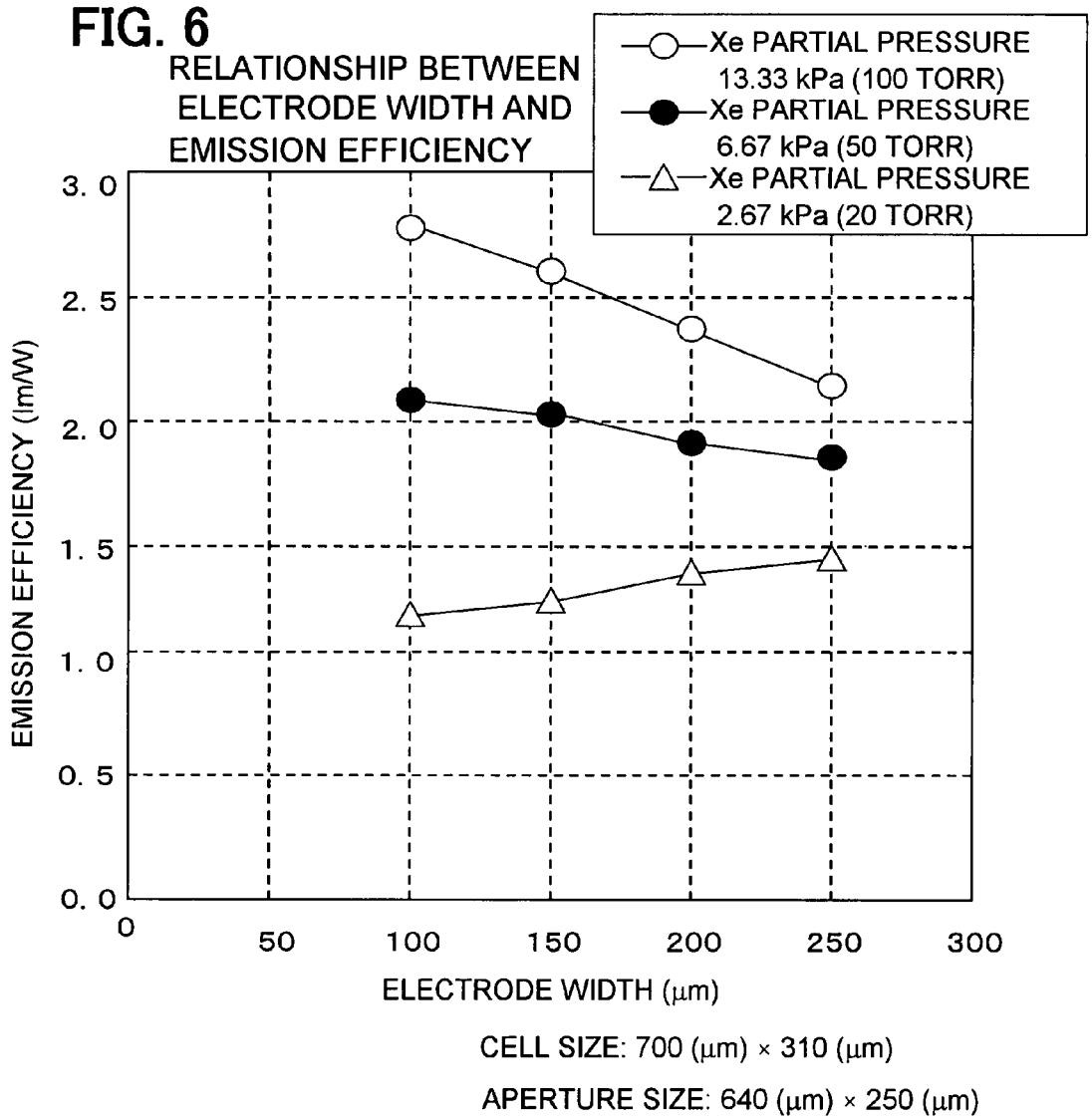
FIG. 6 is a graph depicting the relationship between the electrode width and emission efficiency in a PDP.

FIG. 6 shows the relationship between the width in the column direction of the row electrode (hereafter called electrode width) in the PDP when Wx1 and Wy1 are the same, and the emission efficiency.

The measurement results when the size of the discharge cell is 700 (μm)×310 (μm) and the aperture size is 640 (μm)×250 (μm) are shown in FIG. 6.

According to FIG. 6, when the partial pressure of xenon is less than 6.67 kPa (50 Torr) (FIG. 4 shows the case when the partial pressure of xenon is 2.67 kPa (20 Torr)), the emission efficiency decreases as the electrode width decreases.

And when the partial pressure of xenon is 6.67 kPa (50 Torr) or more, the emission efficiency increases as the electrode width decreases, and as the partial pressure of xenon increases (FIG. 6 shows the case when the partial pressure of xenon is 13.33 kPa (100 Torr)), the increase of emission efficiency becomes conspicuous.

As an emission efficiency demanded for PDP, a value of 2.0 (1 m/W) or more is usable.

According to the measurement values shown in FIG. 6, an emission efficiency of 2.0 (1 m/W) or more can be implemented if the electrode widths Wx1 and Wy1 of the row electrodes X1 and Y1 are 150 μm or less respectively in a state where the partial pressure of xenon in the discharge gas is set to 6.67 kPa (50 Torr) or more in PDP 10.

Figure 7:
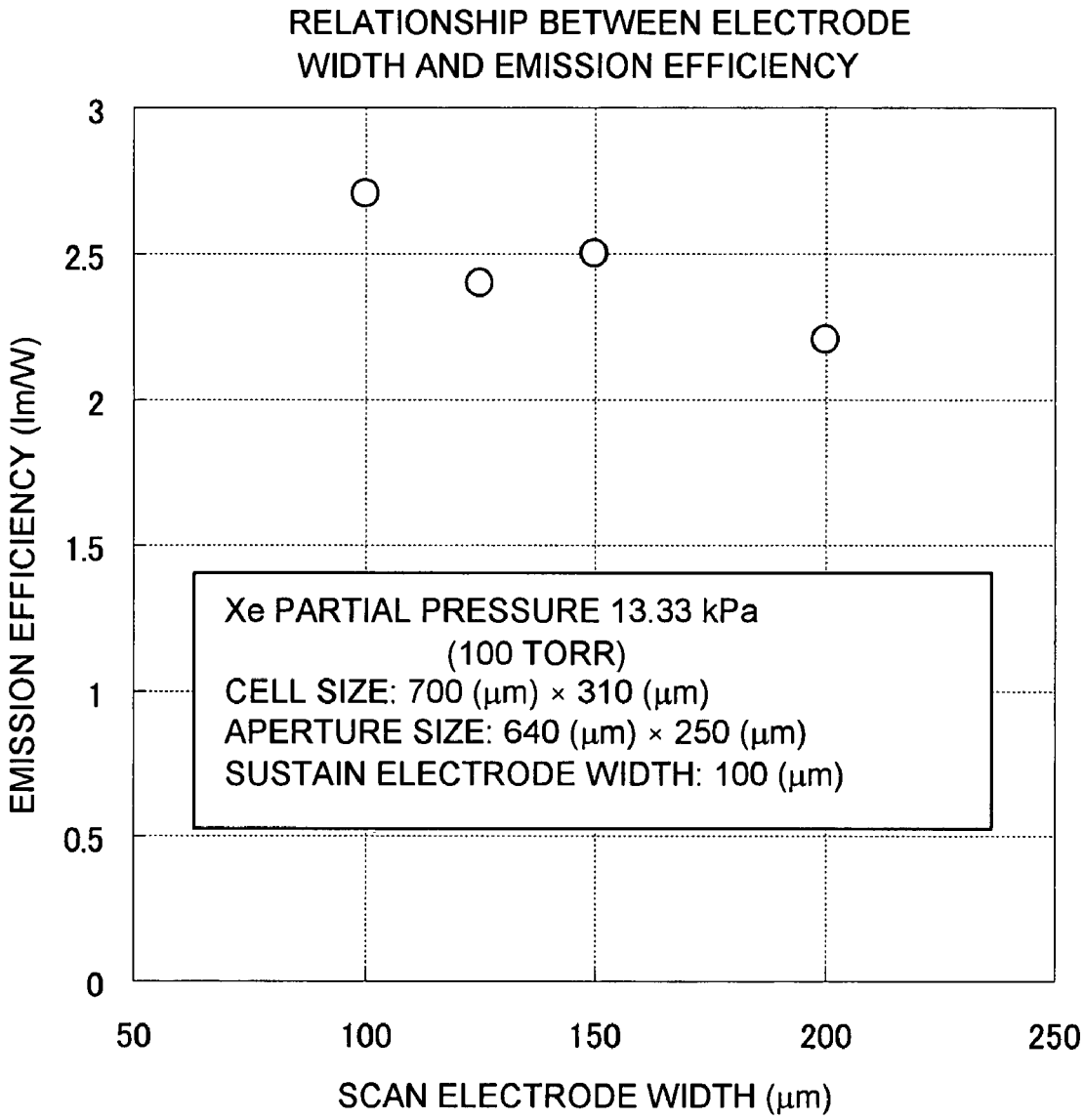
FIG. 7 shows data when the dependency of the emission efficiency on the electrode width was measured.

It was discovered that such a discharge with high emission efficiency can be implemented not only by decreasing the electrode widths Wx1 and Wy1 respectively, but by decreasing only one of the electrode widths Wx1 and Wy1. FIG. 7 shows the data when the dependency of emission efficiency on the electrode width of one side of the row electrodes X1 and Y1 was measured. The measurement conditions are the same for the PDP used as the measurement target in FIG. 6.

As shown here, even when only one side of the electrode width is decreased, the depth where the discharge generated between the row electrodes spreads in the unit emission area of the discharge space becomes narrower compared with a conventional PDP, the discharge is limited to a small area near the discharge gap overlapping with the generation area of an initial glow discharge, and high emission efficiency is sustained.

According to the measurement results in FIG. 5 and FIG. 7, it is clear that if the electrode width of the row electrode Y1 is increased, the address discharge voltage drops dramatically (see FIG. 5). Whereas emission efficiency does not change even if the electrode width of the row electrode Y1 is changed (see FIG. 7).

In the above embodiments, the configuration of setting the electrode width of the row electrode Y1 to be wider than the electrode width of the row electrode X1 was described corresponding to the first embodiment of the previous application (Japanese Patent Application Laid-Open No. 2005-241274).

The application of the present invention, however, is not limited to this case, and needless to say, application is possible for other embodiments of the previous application.

In other words, as the configuration where at least the width in the column direction of one electrode in the area related to the discharge performed via the respective gap of a pair of row electrodes X1 and Y1 constituting the row electrode pair is set to 150 μm or less, the following equivalent modes can be used other than the configuration of setting the width of the row electrode Y1 to be wider than the width of the row electrode X1 when the width in the column direction of each row electrode is 150 μm or less, as shown in FIG. 2.

Figure 8A:
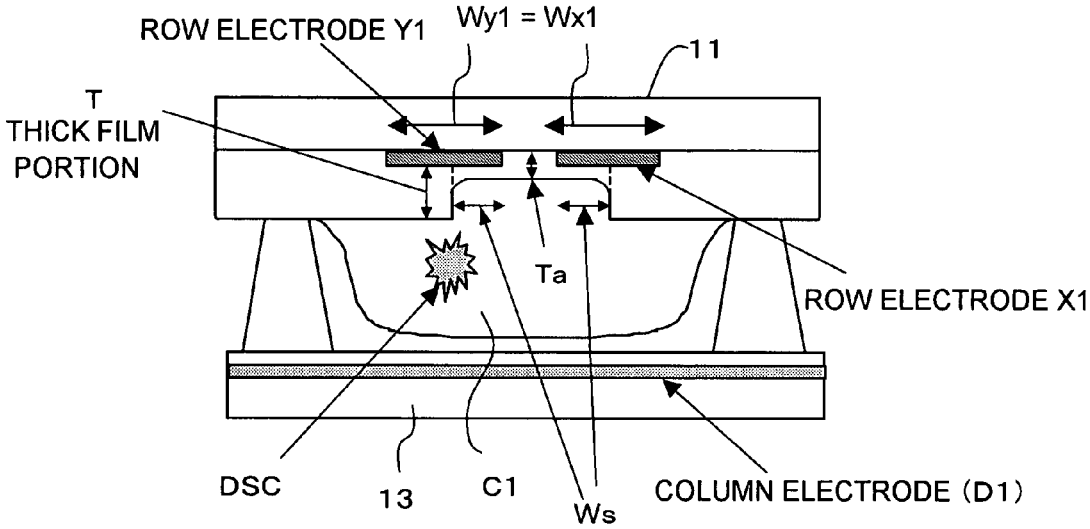
FIG. 8A is a diagram depicting a configuration according to the previous application where the width of the row electrode Y1 is set to be wider than the width of the row electrode X1.
Figure 8B:
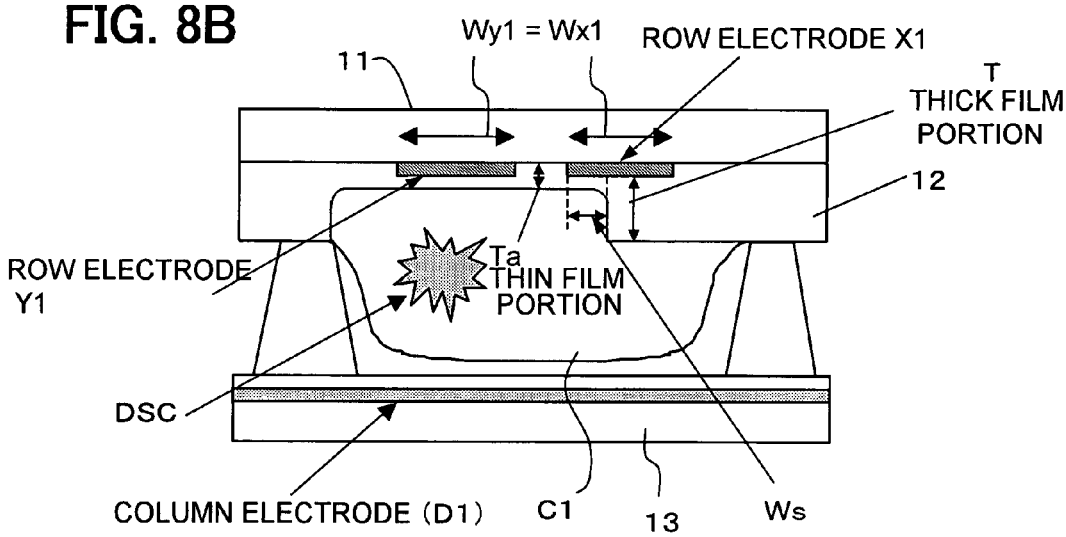
FIG. 8B is a diagram depicting a configuration example according to the invention of the present application for comparison with the configuration in FIG. 8A;.

The first mode is shown in FIG. 8A and FIG. 8B. FIG. 8A is a diagram depicting another configuration based on the principle according to the previous application on setting the width of the row electrode Y1 to be wider than the width of the row electrode X1.

The electrode widths of the row electrodes X1 and Y1 are the same (Wy1=Wx1), and are the widths (400 μm to 1000 μm) used for a conventional PDP, but concerning the thickness T of the dielectric thick film portion covering the row electrodes X1 and Y1, the thickness Ta of the width area Ws, of which electrode widths of the row electrodes X1 and Y1 are 150 μm or less respectively, is formed to be thinner than that of the other area of the dielectric thick film portion 12. By this, the electrode widths of the row electrodes X1 and Y1 both become equivalent to 150 μm or less.

Whereas FIG. 8B shows a configuration example according to the present invention, comparing with the configuration in FIG. 8A.

In the configuration shown in FIG. 8B, the width in the column direction of each row electrode X1 and Y1 can be a width in a conventional PDP (400 μm to 1000 μm), just like the configuration of the previous application shown in FIG. 8A. The characteristics are that in the dielectric layer 12 covering the pair of row electrodes X1 and Y1, the thickness Ta of the dielectric layer 12 covering the entire width of the row electrode Y1 to which the scan pulse is applied and the 150 μm or less width area Ws of the electrode width of the sustain row electrode X1 is made thin, and the thickness of the other portion of the dielectric layer 12 is made to be a double or more thickness T so that wall charges are not generated.

By this configuration, substantial widths in the column direction of the row electrodes can be set. In this case, the width of the area of the portion where the thickness of the dielectric layer 12 is made thin is wider in the row electrode Y1 than in the row electrode X1.

Figure 9A:
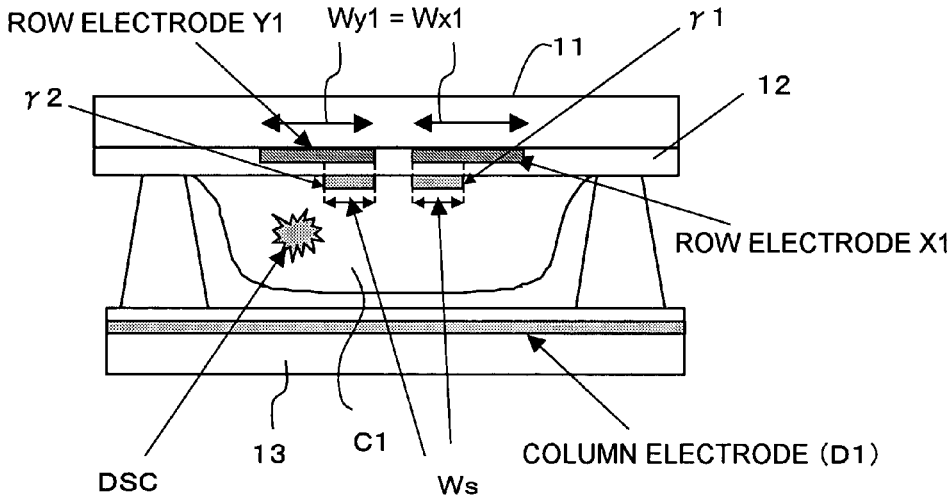
FIG. 9A is a diagram depicting still another configuration according to the previous application where the width of the row electrode Y1 is set to be wider than the width of the row electrode X1.
Figure 9B:
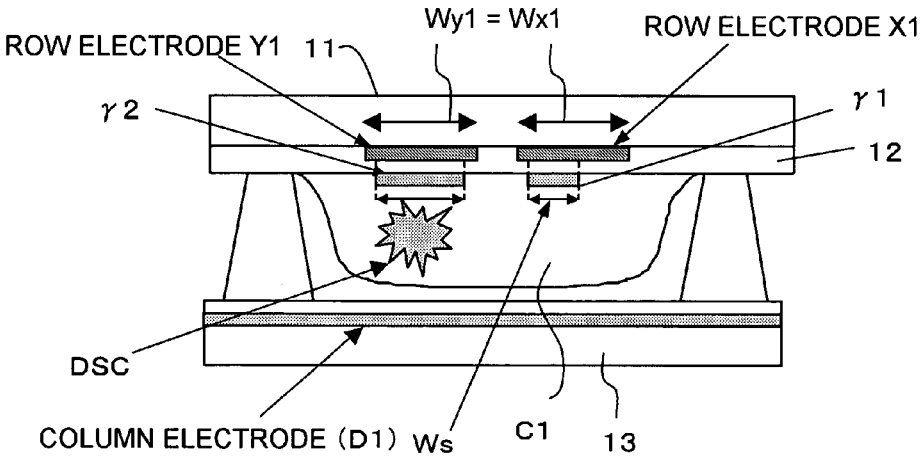
FIG. 9B is a diagram depicting a configuration example according to the invention of the present application, for comparison with the configuration in FIG. 9A.

Another possible mode is the mode described in FIG. 9A and FIG. 9B. FIG. 9A is a diagram depicting another configuration based on the principle according to the previous application of setting the width of the row electrode Y1 to be wider than the width of the row electrode X1.

In FIG. 9A, the electrode widths of the row electrodes X1 and Y1 are the same (Wy1=Wx1), and can be a width in a conventional PDP (400 μm to 1000 μm). Compared with the configuration in FIG. 8A, instead of decreasing the thickness of the dielectric layer 12 covering the respective end portions of the row electrodes X1 and Y1, secondary electron emission layers γ1 and γ2 are formed with high γ material only for the areas corresponding to the end portions of the row electrodes X1 and Y1, on the dielectric layer 12 covering the row electrodes X1 and Y1, which are an electrode pair. In the configuration of the previous application shown in FIG. 9A, the widths Ws of the respective end portions of the secondary electron emission layers γ1 and γ2 are 150 μm or less.

Whereas FIG. 9B is a diagram depicting the configuration example according to the present invention in comparison with the configuration in FIG. 9A.

In the configuration shown in FIG. 9B, the width in the column direction in each row electrode can be a width in a conventional PDP (400 μm to 1000 μm), just like the configuration of the previous application shown in FIG. 9A. The areas of the secondary electron emission layers γ1 and γ2, made from high γ material formed on the dielectric layer 12 covering the scan row electrode Y1 to which the scan pulse is applied and the row electrode X1 to which the sustain pulse is applied, have sizes according to the area width Ws corresponding to only the end portion of the row electrode X1 (150 μm or less) and the area width corresponding to the row electrode Y1.

In other words, in the example shown in FIG. 9B, the width of the secondary electron emission layer γ2 corresponding to the scan row electrode Y1 is formed to be wider than the width Ws of the secondary electron emission layer γ2 corresponding to the sustain row electrode X1.

In this way, the substantial width in the column direction of the row electrode can be set by limiting the area where the sustain discharge can be sustained. In this case as well, the size of the portion, where the secondary electron emission layer is formed, is larger in the row electrode Y1 than in the row electrode X1.

In the above embodiment, a configuration of disposing the bus electrodes X1*b* and Y1*b* on the transparent electrodes X1*a* and Y1*a* with electrical contact was described, but the configuration of the bus electrodes is not limited to this embodiment, but the application and effects of the present invention can also be implemented by various other configurations.

As mentioned above, the width in the column direction of at least one electrode out of a pair of row electrode composing elements constituting the row electrode pair is set to 150 μm or less, which is smaller than 400 to 1000 μm of a conventional PDP, so the depth where the discharge generated between the row electrodes spreads in the unit emission area of the discharge space becomes narrower than a conventional PDP, and the growth area of the discharge is limited to a narrow area near the discharge gap overlapping with the initial glow discharge generation area.

Therefore in the PDP according to this embodiment, vacuum ultraviolet rays are generated from xenon in the discharge gas at a much higher efficiency than a conventional PDP.

Since the partial pressure of xenon in the discharge gas is set to 6.67 kPa (50 Torr) or more, the fluorescent layer is excited mainly by the molecular line of which wavelength is 172 nm, out of the vacuum ultraviolet rays generated from xenon in the discharge gas, and the molecular line is hardly attenuated during the process of propagating through the discharge gas, unlike the resonance line, therefore the vacuum ultraviolet rays sufficiently reach the fluorescent layer even if the discharge generated between the row electrodes is localized in a range near the discharge gap.

Because of this, the characteristics of the previous application (Japanese Patent Application Laid-Open No. 2005-241274) of generating vacuum ultraviolet rays at a higher efficiency than a conventional PDP are exhibited as is, and high emission efficiency can be implemented, and also the address discharge voltage can be decreased and the dispersion of address discharge voltage, due to the dispersion of the structure, can be eliminated, and the reliability of a PDP can be increased.

Also in the PDP of the present embodiment, the generation area of the vacuum ultraviolet rays in the unit emission area is smaller than a conventional PDP, so even if the unit emission area is defined by the barriers, the influence from the barriers, such as wall loss, is minimal, and at the same time, the fluorescent layer is excited using the molecular lines of the vacuum ultraviolet rays, so the influence of the dispersion of the distance between the vacuum ultraviolet rays and the fluorescent layer becomes small, and therefore high accuracy of the positions of the row electrode pairs in the column direction with respect to the unit emission area is not demanded, and the present invention can contribute to decreasing the manufacturing cost by improving product yield in the manufacturing steps.

Now the reason why discharge with high emission efficiency is sustained in a state where the partial pressure of xenon in the discharge gas is 6.67 kPa (50 Torr) or more when at least one electrode of the electrode pair is set to 150 μm or less will be described in detail.

Figure 10:
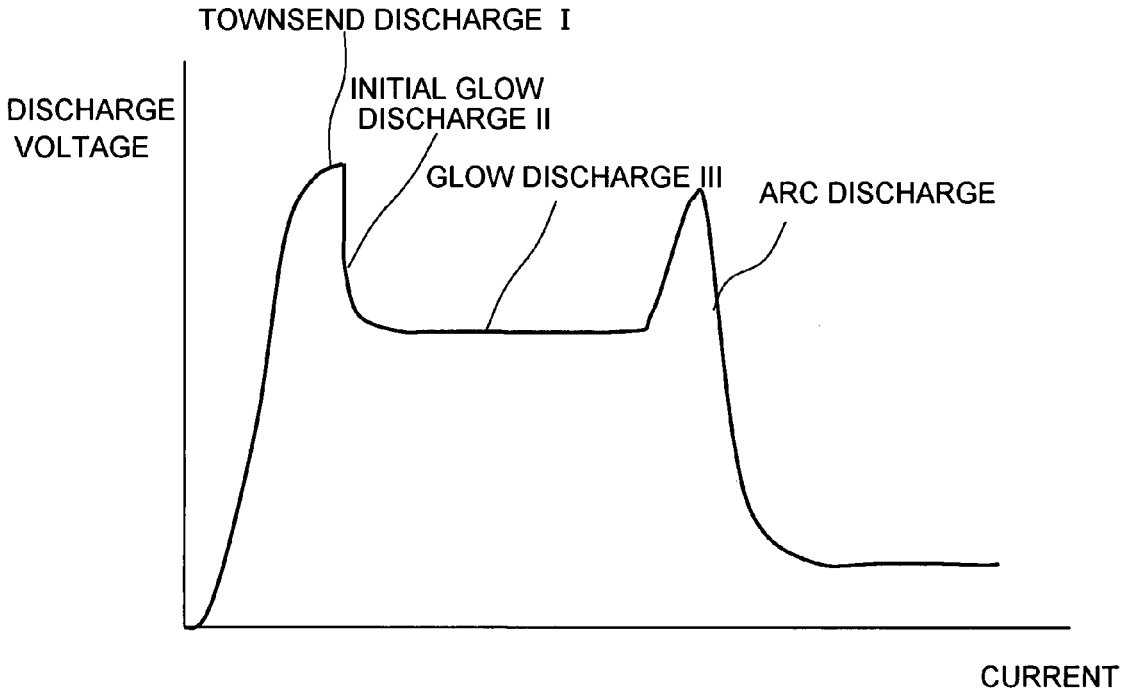
FIG. 10 is a graph depicting general growth process of the discharge in PDP.
Figure 11:
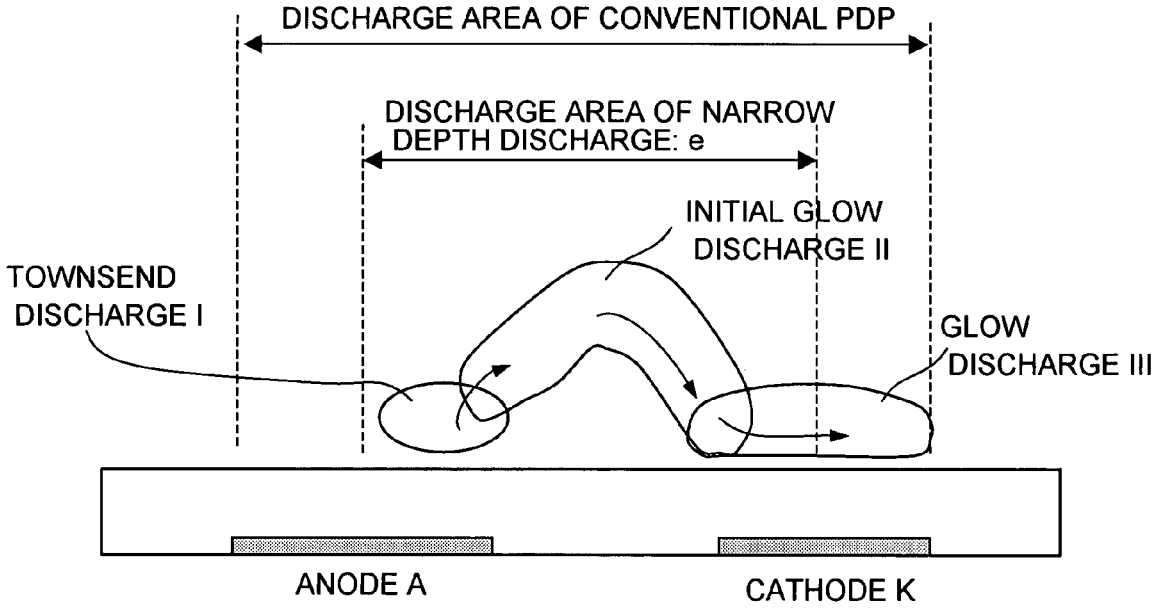
FIG. 11 is a state diagram depicting the growth process of sustain discharge in the discharge cell of a PDP.

FIG. 10 is a graph depicting the general growth process of a discharge, and FIG. 11 is a state diagram depicting the growth process of the sustain discharge in a conventional discharge cell.

As FIG. 10 and FIG. 11 show, the sustain discharge generated in the discharge cell during the above mentioned image formation time grows via the process of the Townsend discharge I—initial glow discharge II—glow discharge III.

To generate vacuum ultraviolet rays during the image formation of a PDP, the initial glow discharge I and the glow discharge II periods, out of the sustain discharge generation periods, are normally used.

And out of the discharge period used for the generation of the vacuum ultraviolet rays, vacuum ultraviolet rays are generated at very high efficiency in the initial glow discharge I period, since energy loss does not occur at the cathode fall section, which is generated near the cathode mainly by ions, in the process before the localization of spatial charges completes.

In the glow discharge II period after the initial glow discharge I period, a very strong electric field is generated in the discharge space by the generation of the cathode fall section, a large quantity of high energy electrons are generated by this strong electric field, and a large quantity of vacuum ultraviolet rays are generated in a negative glow section, which is an exit of the strong electric field section, but the generation efficiency of the vacuum ultraviolet rays is not high compared with the initial glow discharge I period, since an energy loss is generated in the cathode fall section.

The sustain discharge generated in the discharge cell C1 of PDP grows three-dimensionally from the anode A side of the row electrode pair to the cathode K side in the growth process, as shown in FIG. 11.

In the PDP 10, the electrode width Wx1 of the row electrodes X1 and Y1 is set to 150 μm or less, and the depth where the sustain discharge spreads in the discharge cell C1 is narrower than a conventional PDP, so the growth area of the sustain discharge is limited to a narrow area near the discharge gap g1 (area indicated by e in FIG. 11).

In this PDP 10, the sustain discharge generated in the narrow area near the discharge gap g1 is hereafter called the "narrow depth discharge".

The form of the sustain discharge in the AC type PDP is determined by the electrode of which width is narrower, so a narrow depth discharge is induced only if one electrode is set to 150 μm or less.

The growth area of this narrow depth discharge overlaps with the generation area of the initial glow discharge in FIG. 11, where the vacuum ultraviolet rays are generated at very high efficiency, which was mentioned above.

Therefore in the PDP 10, the electrode width Wx1 of the row electrode X1 is set to 150 μm or less so that the sustain discharge becomes a narrow depth discharge, and as a result vacuum ultraviolet rays are generated at a much higher efficiency than a conventional PDP.

On the other hand, in the PDP 10, if discharge gas of which partial pressure of xenon is low is filled into the discharge space, and an attempt to excite the fluorescent layer 16 is made primarily by the resonance line of which wavelength is 147 nm, out of the vacuum ultraviolet rays generated from the xenon in the discharge gas, the sustain discharge, which is a narrow depth discharge generated in the PDP 10, is localized in a range near the discharge gap g1, so attenuation of the resonance line of the vacuum ultraviolet rays until reaching the fluorescent layer 16 increases.

If the partial pressure of the xenon in the discharge gas is 2.67 to 3.33 kPa (20 to 25 Torr), then it is known that the main component of the vacuum ultraviolet rays generated from the discharge gas is the resonance line of which wavelength is 147 nm, and this resonance line attenuates to approximately half while propagating for 100 μm in the discharge gas when the partial pressure of the xenon is 2.67 to 3.33 kPa (20 to 25 Torr).

In this PDP 10, the partial pressure of the xenon in the discharge gas is set to 6.67 kPa (50 Torr) or more, so the fluorescent layer 16 is excited primarily by the molecular line of which wavelength is 172 nm, out of the vacuum ultraviolet rays generated from the xenon in the discharge gas.

This molecular line of the vacuum ultraviolet rays hardly attenuates in the process of propagating through the discharge gas, unlike the resonance line.

Therefore in the PDP 10, the sustain discharge becomes a narrow depth discharge, and the vacuum ultraviolet rays sufficiently reach the fluorescent layer 16 even if the sustain discharge is localized in a range near the discharge gap g1, so a characteristic where the vacuum ultraviolet rays are generated at a much higher efficiency than a conventional PDP, by the sustain discharge becoming a narrow depth discharge, can be utilized as is, and by this, high emission efficiency can be implemented.

The above effect can also be implemented when the barriers of the PDP have a strip shape, but in the case of a PDP 10 where the barriers 15 are formed substantially in a lattice shape, the fluorescent layer 16 is also formed on the first wall sections 15A, and the four side faces of the second wall sections 15B enclosing each discharge cell C1 and the surface area of the fluorescent layer 16 is increased, so an even higher emission efficiency can be implemented.

Also in the above PDP 10, the width in the column direction of the row electrode X1 is much narrower than a conventional PDP, so the electrostatic capacity generated between the electrodes decreases dramatically, and as a result, the generation of reactive current is decreased and power consumption can be decreased.

In the above example, the row electrode pair (X1, Y1) of the PDP 10 is disposed at the center position of the discharge cell C1 in the column direction, but the row electrode pair (X1, Y1) may be disposed at a position vertically shifted from the center position of the discharge cell C1 in the column direction.

The reason for this is as follows.

In a conventional PDP, sustain discharge becomes a deep discharge which spreads throughout the entire discharge cell, so if the row electrode pair is positioned at a position vertically shifted from the center position of the discharge cell in the column direction with respect to the discharge cell defined by lattice shaped barriers, the discharge gap is shifted to either to the top or bottom lateral walls of the barriers defining the discharge cell, dispersion is generated in the voltage margins, brightness and emission efficiency depend on each discharge cell, and emission is affected, therefore high position accuracy is demanded for the row electrode pair with respect to the discharge cell.

However in the PDP 10, the sustain discharge becomes the above mentioned narrow depth discharge where the discharge area is narrow, and the vacuum ultraviolet ray generation area becomes a point light source which is smaller than a conventional PDP, so the influence from the barriers, such as wall loss, decreases, and also the fluorescent layer 16 is excited using the molecular line of which wavelength is 172 nm with which the absorption of the vacuum ultraviolet rays is low, so the influence of dispersion of the distance between the discharge area of the sustain discharge (vacuum ultraviolet generation area) and the fluorescent layer 16 decreases, and therefore even if the position in the column direction of the row electrode pair (X1, Y1) with respect to the discharge cell C1 is shifted from the center position, emission efficiency and brightness change little.

Therefore according to the above PDP 10, even if the barriers 15 have substantially a lattice shape and the discharge cell C1 is enclosed with the first wall sections 15A and the second wall sections 15B, the position of the discharge gap (that is, the position of the row electrode pair) need not be accurately positioned at the center position of the discharge cell in the column direction, and the tolerance of the position accuracy of the row electrode pair (X1, Y1) with respect to the discharge cell C1 increases, so the present invention can contribute to the decrease of the manufacturing cost by improving product yield in the manufacturing steps.

In the above example, the transparent electrode constituting the row electrode is formed in a continuous strip shape between adjacent discharge cells along the bus electrode, but the transparent electrode may be formed independently for each discharge cell and be connected to the bus electrode.

Also in the above example, the row electrode is comprised of the transparent electrode and the bus electrode, but the row electrode may be comprised only of a metal bus electrode, and the width of at least one of the electrode pair in the column direction may be set to 150 μm or less.

The foregoing description of the embodiments is not intended to limit the invention to the particular details of the examples illustrated. Any suitable modification and equivalents may be resorted to the scope of the invention. All features and advantages of the invention which fall within the scope of the invention are covered by the appended claims.

What is claimed is:

1. A plasma display panel, comprising:

a pair of substrates facing each other with at least one discharge space therebetween; a plurality of row electrode pairs which extend in a row direction and are formed on one of the substrates, each pair being formed by said row electrodes facing each other via a discharge gap respectively; a dielectric layer formed on the substrate and covering the row electrode pairs; and a plurality of column electrodes which extend in a column direction and are formed in the row direction on the other substrate, a unit emission area being formed in the discharge space at each portion where the column electrode and row electrode pair cross, and discharge gas containing xenon being sealed in the discharge space, wherein the dielectric layer comprises a thin film portion and a thick film portion, and the thin film portion of the dielectric layer is formed to be an area having a width of 150 μm or less in a column direction on at least one of the said row electrode of the row electrode pair, and a thin film having a width in the column direction wider than the width in the column direction of the thin film which is set to 150 μm or less is formed on the other row electrode of the row electrode pair, and a partial pressure of xenon in the discharge gas is set to 6.67 kPa or more.

2. The plasma display panel according to claim 1, wherein the thickness of the thick film portion of the dielectric layer is set to double the thickness of the thin film portion of the dielectric layer or more.

3. The plasma display panel according to claim 2, wherein the thin film portion of the dielectric layer is formed in a strip shape extending in the row direction.

4. The plasma display panel according to claim 2, wherein the thin film portion of the dielectric layer is formed in an island shape for each unit emission area, and the thick film portion is formed substantially in a lattice shape.

5. The plasma display panel according to claim 2, wherein barriers are formed substantially in a lattice shape between the pair of substrates, by a plurality of first wall sections of the barriers which extend in the row direction and a plurality of second wall sections of the barriers which extend in the column direction, and a discharge space is divided into individual unit emission areas by the barriers, and the row electrode is disposed at a position facing the unit emission area obtained by division by the barriers respectively.

6. The plasma display panel according to claim 1, wherein the thin film portion of the dielectric layer is formed in a strip shape extending in the row direction.

7. The plasma display panel according to claim 1, wherein the thin film portion of the dielectric layer is formed in an island shape for each unit emission area, and the thick film portion is formed substantially in a lattice shape.

8. The plasma display panel according to claim 1, wherein barriers are formed substantially in a lattice shape between the pair of substrates, by a plurality of first wall sections of the barriers which extend in the row direction and a plurality of second wall sections of the barriers which extend in the column direction, and a discharge space is divided into individual unit emission areas by the barriers, and the row electrode is disposed at a position facing the unit emission area obtained by division by the barriers respectively.

9. A plasma display panel, comprising:

a pair of substrates facing each other with at least one discharge space therebetween;

a plurality of row electrode pairs which extend in a row direction and are formed on one of the substrates, each pair being formed by said row electrodes facing each other via a discharge gap respectively;

a dielectric layer formed on one substrate side and covering the row electrode pairs; and a plurality of column electrodes which extend in a column direction and are formed in the row direction on the other substrate side, a unit emission area being formed in a discharge space at each portion where the column electrode and row electrode pair cross, and discharge gas containing xenon being sealed in the discharge space, wherein a secondary electron emission layer of which width in the column direction is 150 μm or less is formed with a high γ material on a dielectric layer covering at least one row electrode out of the row electric pairs, and a secondary electron emission layer, of which width in the column direction is wider than the column direction width of the high γ material being set to 150 μm or less, is formed with a high γ material on a dielectric layer covering the other row electrodes of the row electrode pairs, and a partial pressure of xenon in the discharge gas is set to 6.67 kPa or more.

* * * * *